US008136690B2

(12) United States Patent
Fang et al.

(10) Patent No.: US 8,136,690 B2
(45) Date of Patent: Mar. 20, 2012

(54) SENSING THE AMOUNT OF LIQUID IN A VESSEL

(75) Inventors: Yun Fang, Kirkland, WA (US); David Michael Morelock, San Clemente, CA (US); Prafulla Masalkar, Issaquah, WA (US)

(73) Assignee: Microsoft Corporation, Redmond, WA (US)

( * ) Notice: Subject to any disclaimer, the term of this patent is extended or adjusted under 35 U.S.C. 154(b) by 291 days.

(21) Appl. No.: 12/423,716

(22) Filed: Apr. 14, 2009

(65) Prior Publication Data

US 2010/0258575 A1 Oct. 14, 2010

(51) Int. Cl.
*B65D 25/54* (2006.01)

(52) U.S. Cl. ..... 220/600; 73/323; 73/327; 220/662

(58) Field of Classification Search ..... 220/662; 73/293, 323, 324, 290 B, 327; 281/4, 12
See application file for complete search history.

(56) References Cited

U.S. PATENT DOCUMENTS

| | | | | |
|---|---|---|---|---|
| 5,462,880 | A * | 10/1995 | Kane et al. | 436/138 |
| 5,485,938 | A * | 1/1996 | Boersma | 220/714 |
| 5,712,934 | A * | 1/1998 | Johnson | 385/12 |
| 6,173,609 | B1 | 1/2001 | Modlin et al. | |
| 6,301,961 | B1 * | 10/2001 | Rolfes et al. | 73/328 |
| 7,603,901 | B1 * | 10/2009 | Tai | 73/323 |
| 2006/0000277 | A1 * | 1/2006 | Pietrorazio | 73/293 |
| 2009/0223290 | A1 * | 9/2009 | Dietz et al. | 73/293 |

FOREIGN PATENT DOCUMENTS

| | | |
|---|---|---|
| EP | 0334533 B1 | 9/1989 |
| EP | 0953843 B1 | 11/1999 |

OTHER PUBLICATIONS

"Microsoft Surface Table to Ensure Glasses Never Empty", Retrieved at <<http://www.drinkhacker.com/2008/10/23/microsoft-surface-table-to-ensure-glasses-never-empty/>>, Jan. 12, 2009, pp. 5.

Dietz, et al., "Wireless Liquid Level Sensing for Restaurant Applications", Retrieved at <<http://www.merl.com/papers/docs/TR2002-21.pdf, TR2002-21 Apr. 2002, pp. 10.

"Smart Glasses Order Own Refills", Retrieved at <<http://news.bbc.co.uk/1/hi/sci/tech/1910627.stm>, Apr. 4, 2002, pp. 2.

Shelley, ""Smart Glass" Tells Waiter When It's Empty", Retrieved at <<http://findarticles.com/p/articles/mi_qn4182/is_20020417/ai_n10151858, Apr. 17, 2002, pp. 5.

Morris, et al., "A Digital Fiber-optic Liquid Level Sensor", Retrieved at <<http://ieeexplore.ieee.org/stamp/stamp.jsp?arnumber=01075598>>, Journal of Lightwave Technology, vol. LT-5, No. 7, Jul. 1987, pp. 920-925.

* cited by examiner

*Primary Examiner* — Mickey Yu
*Assistant Examiner* — Rafael Ortiz
(74) *Attorney, Agent, or Firm* — Alleman Hall McCoy Russell & Tuttle LLP

(57) ABSTRACT

A vessel comprising a fluid-confining surface, a basal surface disposed below the fluid-confining surface, and a light guide. The light guide includes a first window partly defining the basal surface and a second window partly defining the fluid-confining surface, where the second window is disposed above a lowest region of the fluid-confining surface. In other embodiments, an isolating structure is provided that substantially surrounds the light guide between the first and second windows.

15 Claims, 5 Drawing Sheets

FIG. 8
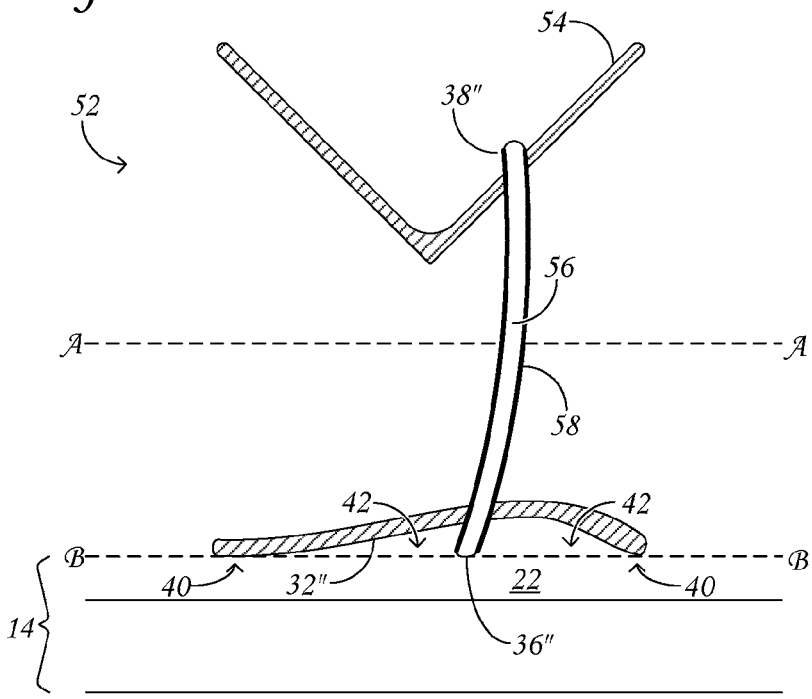
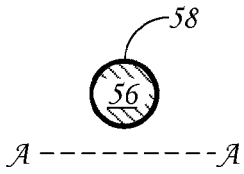
FIG. 9
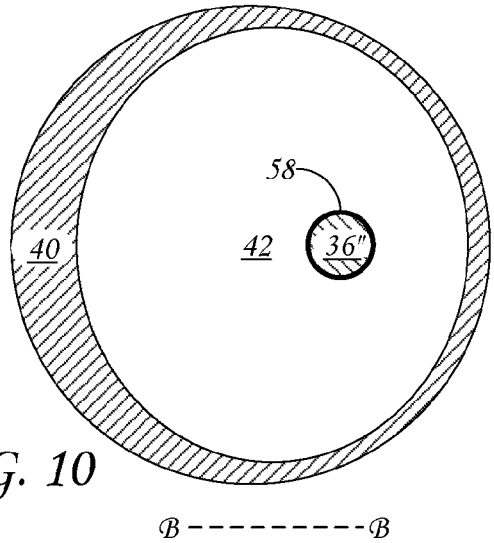
FIG. 10

SENSING THE AMOUNT OF LIQUID IN A VESSEL

BACKGROUND

A proprietor of a restaurant or tavern has a vested interest in providing prompt service to his or her customers while controlling operating costs. Prompt service may include minimizing the time that a customer spends waiting for a beverage refill. Such time may include unnecessary delays of various kinds—the customer's delay in noticing that his or her beverage is nearly empty or the wait staff's delay in asking the customer if a refill is desired. Providing a larger wait staff in the restaurant or tavern may reduce some of the unnecessary delays, but it also may result in greater operating expenses.

SUMMARY

Therefore, one embodiment provides an example system for indicating when to offer a beverage refill to a customer. The system includes a specially configured vessel having a fluid-confining surface, a basal surface, and a light guide. The light guide includes a first window partly defining the basal surface of the vessel and a second window partly defining the fluid-confining surface of the vessel. By measuring an intensity of light reflected from the second window, the system may determine whether the level of fluid in the vessel has fallen below a threshold level. In some embodiments, an isolating structure is provided that substantially surrounds the light guide between the first and second windows. This example system may be configured to indicate that a beverage refill should be offered to a customer when the level of liquid in the vessel falls below a threshold level.

It will be understood that the summary above is provided to introduce in simplified form a selection of concepts that are further described in the detailed description, which follows. It is not meant to identify key or essential features of the claimed subject matter, the scope of which is defined by the claims that follow the detailed description. Further, the claimed subject matter is not limited to implementations that solve any disadvantages noted above or in any part of this disclosure.

BRIEF DESCRIPTION OF THE DRAWINGS

FIG. 8 shows a vertical cross section of a second example vessel and tabletop, in accordance with the present disclosure.

FIG. 9 shows a horizontal, cross-sectional view of the second example vessel, in accordance with the present disclosure.

FIG. 10 shows a cross-sectional view of the interface between the second example vessel and a tabletop, in accordance with the present disclosure.

DETAILED DESCRIPTION

Figure 1:
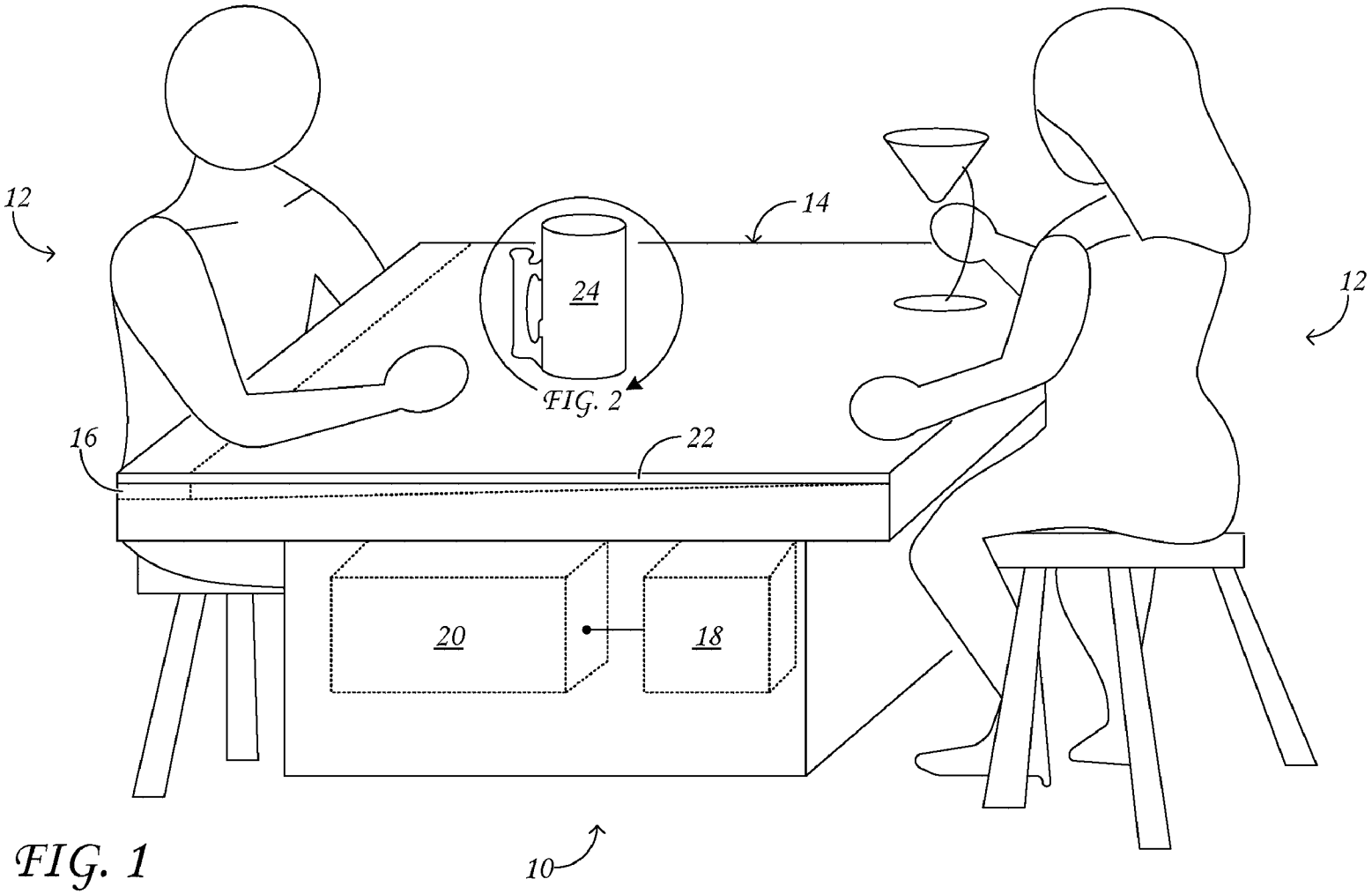
FIG. 1 shows an embodiment of a system for indicating when to offer a beverage refill to a customer, in accordance with the present disclosure.

FIG. 1 shows an embodiment of a system for indicating when to offer a beverage refill to a customer. The system may be installed, for example, in a restaurant or tavern. It includes table 10, a furnishing configured to provide functionality as well as structure. For example, the table may include various input/output components enabling customers 12 to order food or drinks from a menu, to play games, to navigate the Internet, etc. In these and other embodiments, the table may include one or more functional components configured to recognize when a customer seated at the table should be offered a beverage refill.

Accordingly, FIG. 1 schematically shows selected functional components of table 10 according to one, example embodiment. The drawing shows tabletop 14, with illuminant 16 disposed inside the tabletop and detector 18 disposed below the tabletop. In other configurations fully consistent with this disclosure, the relative positions and orientations of these components may differ. In some embodiments, for example, optical elements not shown in FIG. 1 may focus an image from the tabletop to a detector disposed within the tabletop.

Continuing in FIG. 1, illuminant 16 may comprise a light-emitting diode array and a waveguide. The illuminant may be configured to project visible and/or infrared light from the upper surface of the tabletop. In this manner, objects placed on the tabletop may be illuminated from below. Detector 18 may be any light detector configured to at least partly capture an image of an object placed on tabletop 14; it may be an infrared-sensitive digital camera, for example. In the illustrated embodiment, the detector is operatively coupled to image-receiving device 20, which is also disposed below the tabletop. In one embodiment, image-receiving device 20 may comprise all or part of a computer configured to process image data from the detector. In other embodiments, however, the image-receiving device may be any device operatively coupled to such a computer via a wired or wireless communications link.

Tabletop 14 may be configured to selectively obscure image transmission therethrough, so that customers 12, seated at table 10, are unable to resolve illuminant 16, detector 18, image-receiving device 20, and/or other components disposed inside or below the tabletop. Various modes of selectively obscuring image transmission through the tabletop are contemplated. For example, the tabletop may be partly reflective and/or partly opaque (e.g., absorbing) in one or more visible wavelength ranges. Further, the ambient lighting provided to the table may be selected to match the one or more wavelength ranges in which the tabletop is partly reflective and/or partly opaque. In another embodiment, the tabletop may be configured to scatter ambient light. Accordingly, the tabletop 14 in FIG. 1 includes diffusing layer 22.

Diffusing layer 22 may obscure transmission of some images through tabletop 14 and allow transmission of others. In particular, the diffusing layer may obscure the image of an object located below tabletop 14 when viewed from above the tabletop. Nevertheless, an image of an object placed directly on or just above the tabletop may be resolvable via detector 18. Accordingly, illuminant 16 may be configured to provide a substantially uniform and diffuse illumination of objects placed on the tabletop. Further, in various contemplated embodiments where the illuminant emits light in one or more infrared wavelength ranges, the light it provides may be substantially invisible to customers 12. However, the detector may be sensitive to the one or more infrared wavelength ranges and configured to resolve the image of the object placed on the tabletop. The detector may be further configured to send one or more images of objects placed on the tabletop to image-receiving device 20.

The objects placed on tabletop 14 may include vessels such as beverage vessels—water glasses, tea cups, shot glasses, mugs, stemware, as examples. Accordingly, FIG. 1 shows an example vessel 24 disposed on the tabletop. In this and other embodiments, image-receiving device 20 may be configured to detect one or more vessels placed on the tabletop by analyzing one or more images captured by detector 18. Such images may provide a partial view of the one or more vessels placed on the tabletop, as described below with reference to FIG. 2.

Figure 2:
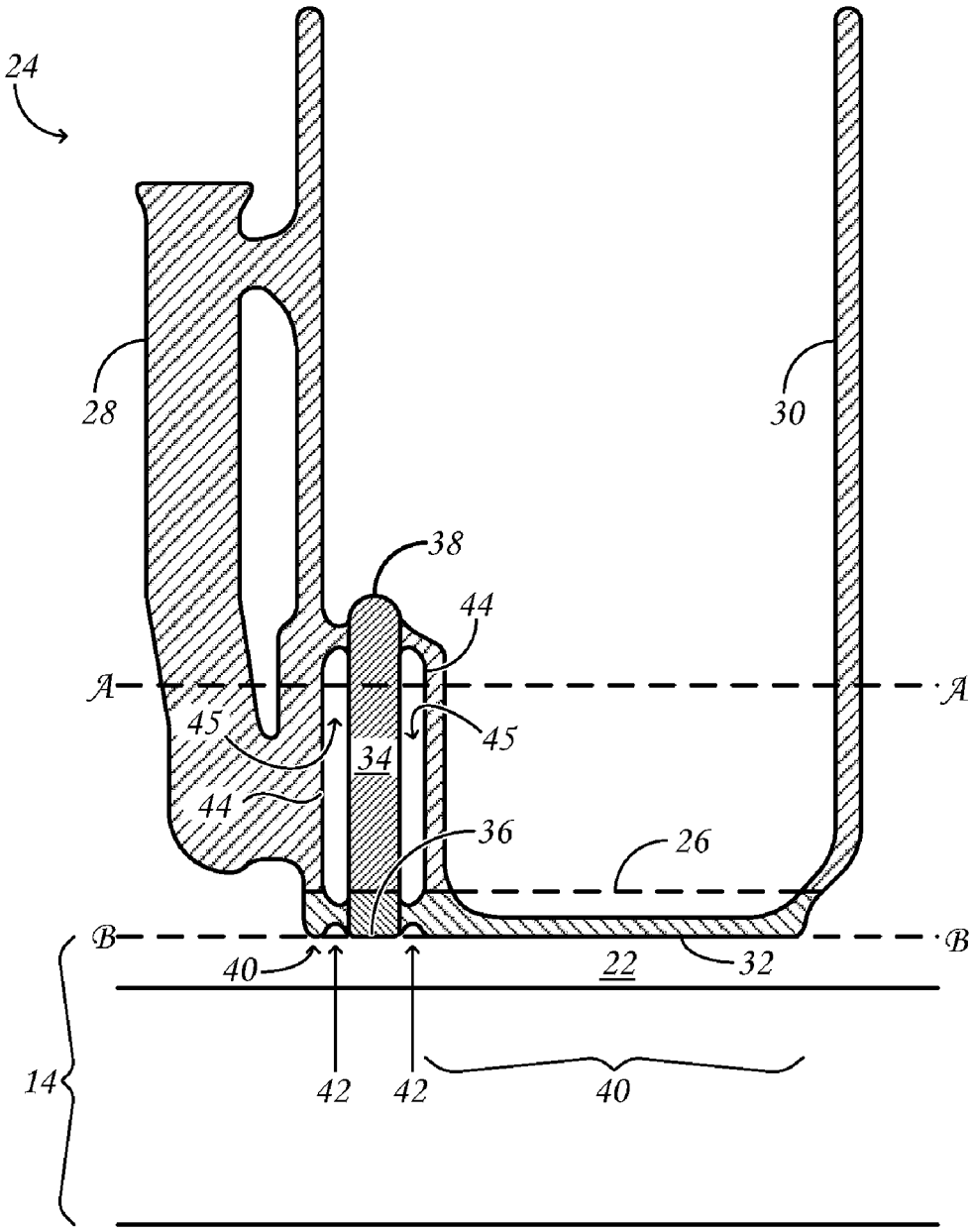
FIG. 2 shows a vertical, cross-sectional view of a first example vessel and a tabletop, in accordance with the present disclosure.

FIG. 2 shows a cross-sectional view of the contact area between vessel 24 and tabletop 14. The drawing shows resolvable section 26 of the vessel, which is the section of the vessel clearly resolved in the images captured by detector 18 and provided to image-receiving device 20. Sections of the vessel that lie outside the resolvable section may appear fuzzy, faded, indistinct, or invisible in the images captured by the detector. In the illustrated embodiment, the resolvable section is a section of the vessel disposed within a short distance from the tabletop. The actual thickness of the resolvable section may vary depending on the irradiance geometry of illuminant 16, the diffusing properties of diffusing layer 22, the optical properties of the vessel, and the manner in which detector 18 is focused. In one embodiment, the resolvable section may be a two-millimeter thick section extending upward from the exterior bottom of the vessel.

Image-receiving device 20 may be configured to distinguish various properties of one or more vessels on tabletop 14—e.g., the number and type of each vessel—by analyzing one or more images captured by detector 18. Further, the image-receiving device may be configured to determine whether the level of liquid in an appropriately configured vessel falls below a threshold level. In some embodiments, the image-receiving device may be further configured to provide a signal (e.g., a visual or audible signal) indicating that a beverage refill should be offered when the level of the liquid falls below the threshold level. To enable such a determination, vessel 24 may be configured so that, when placed on the tabletop, the level of liquid it contains is manifest optically within resolvable section 26—even though the threshold level may be well outside the resolvable section. In the embodiments described herein, this functionality is enabled via a light guide that extends upward from the resolvable section of the vessel to the liquid-fillable space of the vessel. As described in further detail below, such a configuration allows the level of liquid in the vessel to be registered in one or more images captured by the detector and provided to the image-receiving device. Further, it enables the desired functionality in an aesthetically inoffensive way—i.e., the table and vessel may be adapted to look and feel just like an ordinary table and an ordinary vessel.

In the embodiment illustrated in FIG. 2, vessel 24 is a specially configured beer mug having a handle 28. It will be understood, however, than many other styles and kinds of vessel are contemplated as well, and are fully embraced by the present disclosure. The vessel may be formed from any suitable material or materials. In one embodiment, a partial structure of the vessel may be formed from a first thermoplastic or thermosetting material (glass, silica, polycarbonate, a polyacrylate, etc.) by such methods as compression molding, injection molding, and/or extrusion. The partial structure may then be machined, etched or polished, or in any other suitable way primed for coupling to a second material. Subsequently, the second material—a thermoplastic or thermosetting material the same or different than the first—may be molded around the partial structure to form a composite structure. Alternatively, an adhesive may be used to couple the first and second materials together. Finally, the composite structure may be machined, polished, or in any other suitable way finished to provide a vessel having the desired form and function.

Continuing in FIG. 2, vessel 24 includes fluid-confining surface 30 configured to contain a beverage. The vessel also includes basal surface 32 disposed below the fluid-confining surface. In some embodiments, each of the fluid-confining surface and the basal surface may be a composite surface formed by coupling two materials, as described above. In other embodiments, one or both of the fluid-confining surface and the basal surface may be formed from a single material.

Further, fluid-confining surface 30 and basal surface 32 may, in some embodiments, be spatially distinct sections of the same material surface. In other embodiments, the fluid-confining surface and the basal surface may be surfaces of two or more different structures coupled together. In yet other embodiments, the fluid-confining surface and the basal surface may be separated from each other and coupled via an intervening structure.

Continuing in FIG. 2, vessel 24 further includes light guide 34 configured to admit light projected onto basal surface 32 from tabletop 14 and to reflect some of the light back toward the tabletop. Therefore, the material composition and optical configuration of the tabletop and the light guide may be chosen so that the tabletop and the light guide are at least partly transparent in one or more overlapping wavelength ranges—infrared wavelength ranges, for example. Accordingly, the light guide includes first window 36 partly defining basal surface 32 and second window 38 partly defining fluid-confining surface 30. In the illustrated embodiment, the second window is disposed above a lowest region of the fluid-confining surface. At this level, the second window may be immersed in liquid when the vessel is relatively full, but substantially dry when the vessel is below a threshold level.

Illuminant 16 may be configured to project substantially diffuse light onto the basal surface of vessel 24 when the vessel is rested on tabletop 14. Accordingly, light from the illuminant may enter light guide 34 through first window 36. The light may enter over a range of incidence angles and undergo multiple reflections at the one or more interfaces between the light guide and surrounding media. In particular, light entering the light guide over a certain range of incidence angles may propagate in the light guide via total internal reflection. Thus, the light guide may be configured and disposed to promote total internal reflection of some of the light projected onto the basal surface. As a result of the multiple reflections, some of the light may be projected back through the first window and out of the light guide. This light may be imaged by detector 18. However, some of the light may escape the light guide due to refraction, e.g., refraction through second window 38, and may therefore fail to project back through the first window. The light intensity lost due to refraction through the second window is a function of the power-weighted distribution of incidence angles of the light reaching the second window and on the relative refractive indices of the second window ($n_2$) and of the material phase in contact with the second window ($n_1$). In particular, the ratio of the two refractive indices defines a critical angle θ, measured normal to the interface, $$\theta = \arcsin(n_1/n_2).$$

Light that reaches the second window below the critical angle θ will be lost due to refraction. Therefore, assuming that light from the illuminant is incident on the first window over a broad (e.g., lambertian) distribution of incidence angles, the analysis above predicts that the amount of light lost due to refraction through the second window will increase as $n_1$ increases. When the second window is substantially dry and in contact with air ($n_1$~1.00), because the vessel is nearly empty, relatively less light will be lost due to refraction through the second window, and relatively more light will project back through the first window. However, when the second window is immersed in water ($n_1$~1.33) or alcohol ($n_1$~1.36), because the vessel is substantially full, relatively more light will be lost due to refraction through the second window, and relatively less will project through the first window. As a result, an image of the resolvable section 26 of the vessel will include a brighter region corresponding to the first window when the vessel is nearly empty, and, a dimmer region corresponding to the first window when the vessel is substantially full.

Accordingly, detector 18 may be responsive to light projected from the basal surface, and image-receiving device 20 may be operatively coupled to the detector and configured to respond when an intensity of the light projected from the basal surface—in this example, light projected particularly from a region corresponding to first window 36—exceeds a threshold intensity. The image-receiving device may be further configured to indicate, based on the response, whether or not the customer drinking from vessel 24 should be offered a beverage refill.

In one embodiment, the threshold intensity referred to above may correspond to an absolute intensity. However, various differencing schemes are also contemplated, which may make the indication less prone to interference from stray light. For example, the intensity of light projected from the region of first window 36 may be relative to or ratioed against an intensity of light from some other region of the basal surface.

In these and other embodiments, the reliability of the indication of whether the customer should be offered a drink refill may be enhanced by providing a sufficient signal-to-noise ratio (S/N) for the intensity of light compared to the threshold intensity. Inasmuch as S/N is greater when more light is admitted to the light guide, the basal surface may be adapted to maximize the admittance of light from illuminant 16. Therefore, in one embodiment, the basal surface may further comprise an anti-reflective coating. Further, the anti-reflective coating disposed on the basal surface may serve a second purpose, by reducing the amount of light reflected from areas of the basal surface exterior the first window, thereby reducing N.

Figure 3:
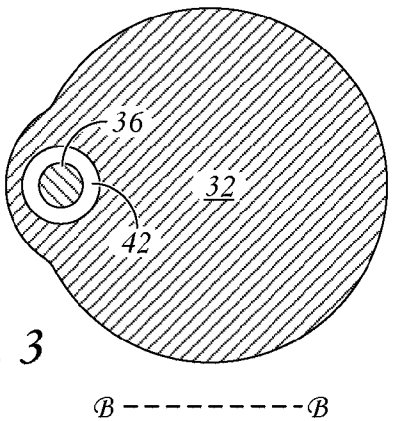
FIG. 3 shows a cross-sectional view of the interface between the first example vessel and a tabletop, in accordance with the present disclosure.

To further enhance S/N, vessel 24 may be configured to minimize refractive losses that occur from regions of the light guide other than second window 38. For example, some refractive loss could occur if the light guide were coupled directly to a relatively high-index material adjacent first window 36. Therefore, the basal surface may be adapted to surround the first window with a low index material such as air. In the embodiment shown in FIG. 2, for example, basal surface 32 is configured, when the vessel is rested on the tabletop, to contact the tabletop in a first region directly below first window 36 and in a second region 40 surrounding the first region, but to stay off the tabletop over a third region 42 between the first and second regions. For additional clarity, a cross-sectional view of the interface between the vessel and the tabletop in the plane B-B is shown in FIG. 3.

Further measures may be taken to guard against unwanted refractive losses from the light guide where it contacts other structures of the vessel. Therefore, with further reference to FIG. 2, vessel 24 includes isolating structure 44 substantially surrounding the light guide between first window 36 and second window 38. In the illustrated embodiment, the isolating structure comprises air-filled jacket 45. In other embodiments, however, the isolating structure may comprise an optically refractive layer adapted to adhere to the light guide, the optically refractive material having a lower refractive index than a material of the light guide to which it adheres. In one embodiment, the light guide may comprise a polycarbonate monolith, and the isolating structure may comprise a material having a lower refractive index than polycarbonate. For example, the isolating structure may comprise glass, polymethylmethacrylate, polymethylpentene, or other polymer materials. In still other embodiments, design constraints may suggest that the light guide and the isolating structure be formed from the same material. In such embodiments, the material may comprise a relatively high-index polymer such as polycarbonate (n=1.58) to maintain suitable S/N.

In embodiments where an isolating structure is included, and where the isolating structure comprises a solid material adapted to adhere to the light guide, the manner of forming the interface between the light guide and the isolating structure may be chosen to provide an optically non-scattering interface. In particular, the manner of forming the interface may be chosen to avoid the trapping of dust and other particulates, and the formation of gas or air bubbles at the interface. In some embodiments, for example, the isolating structure may be applied to the light guide via spray coating, dip coating, or overmoulding. Therefore, to form an optically non-scattering interface, the light guide may be carefully cleaned, chemically etched, plasma-etched, and/or mechanically polished prior to the coating or overmoulding.

In these and other embodiments, the first and second windows of the light guide may be cleaned, etched, and/or polished to limit light scattering. Further, the light guide may be formed in a manner that discourages the trapping of particulates, bubbles, and other scattering loci therein. For example, the light guide may be formed from a filtered, degassed polymer resin, thermoplastic, or other liquid.

Further measures may be taken to discourage the adherence of scattering loci on the second window while the vessel is in use. Such scattering loci may include bubbles or particulates originating from the beverage served in the vessel or from the customer's mouth. Accordingly, the second window may be polished, formed from, and/or coated with a non-stick surface—polycarbonate, polyethylene, polytetrafluoroethylene, etc.—to discourage the adherence of bubbles and particulates that might otherwise accumulate on the second window. Such coating may further serve to ensure that the second window becomes substantially dry when the level of liquid in the vessel descends below the second window.

In the embodiment shown in FIG. 2, the second window defines a non-axial side region of the fluid-confining surface. At this position, the second window and associated structure may appear minimally obtrusive to a customer drinking from or examining the vessel. Further, the second window, disposed at this position, may be relatively protected from solid objects dropped or inserted into the vessel—ice cubes or shot glasses, for example.

Figure 4:
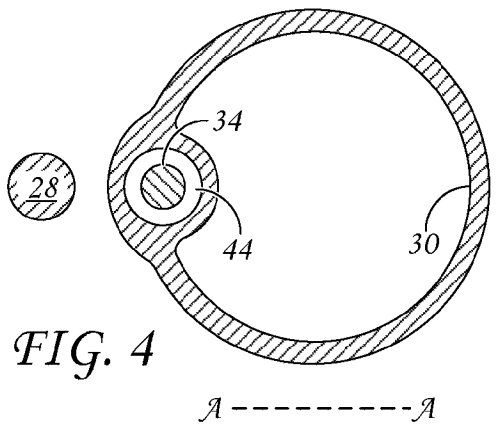
FIG. 4 shows a horizontal, cross-sectional view of the first example vessel, in accordance with the present disclosure.

In the embodiments described herein, the disposition of light guide 34 and/or isolating structure 44 may determine the symmetry properties of vessel 24 and of the fluid-fillable interior thereof. For example, fluid-confining surface 30 may define a space having $C_s$ point symmetry, i.e., the only symmetry element may be a vertical mirror plane passing through the center of the fluid-fillable interior of the vessel and also passing through the light guide. To further illustrate the point symmetry of the embodiment shown in FIG. 2, a cross-sectional view of the vessel in the plane A-A is shown in FIG. 4.

In other embodiments, a vessel may include two or more light guides the same or different than light guide 34. In these embodiments, the fluid-confining surface of the vessel may have a proper rotation axis and one or more additional mirror planes containing the proper rotation axis. In these embodiments, the fluid-confining surface may have a point symmetry higher than $C_s$: $C_{2v}$ or $C_{3v}$, for example.

The present disclosure embraces beverage-vessel embodiments of various configurations and dimensions. For instance, while the illustrated embodiments show vessels having at least one axially symmetric exterior surface, other embodiments may have a substantially prismatic exterior surface. Such a design may increase S/N by providing a more homogeneously reflective outer surface. Irrespective of the configuration of the exterior surface, S/N may be greater for vessels in which the light guide is relatively thick compared to the walls and/or bottom of the vessel (because the walls and bottom also reflect light, contributing to N). Accordingly, the light guide may be greater than 3 millimeters (mm) in radius; it may be 4 to 5 mm in radius, for example. Further, the ratio of radius of the light guide to the wall thickness of the vessel may be 3:2 or greater: 5:2, 7:2, for example. Further still, the ratio of the radius of the light guide to the bottom thickness of the vessel may be 3:2 or greater.

Figure 5:
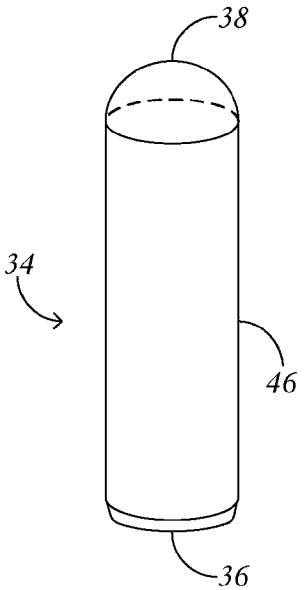
FIG. 5 shows a view of a first example light guide, in accordance with the present disclosure.
Figure 6:
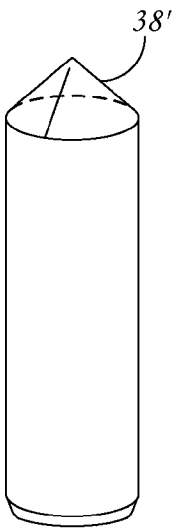
FIG. 6 shows a view of a second example light guide, in accordance with the present disclosure.

FIG. 5 shows another view of light guide 34, comprising first window 36 and second window 38. In this embodiment, the second window comprises a hemispherical surface. In similar embodiments, the second window may comprise virtually any partial spherical surface. In the embodiment shown in FIG. 6, second window 38' of the illustrated light guide comprises a conical surface; in such embodiments, the height of the conical surface may be substantially equal to its basal radius.

Returning to FIG. 5, light guide 34 further comprises light pipe 46 coupled between the first and second windows. In the illustrated embodiment, the light pipe may be a substantially straight or at least slightly curved cylinder. Therefore, a horizontal cross section of the light pipe may be circular, or more generally, elliptical.

Figure 7:
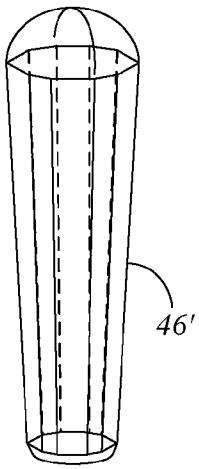
FIG. 7 shows a view of a third example light guide, in accordance with the present disclosure.

FIG. 7 shows another embodiment of a light guide. In this example, the light pipe 46' is a section of a polyhedron having edges that taper outward from the first window to the second window. Therefore, a horizontal cross section of the light pipe may be polygonal. In other examples, the light pipe may be a truncated cone having a taper similar to the polyhedral light pipe shown in the drawing.

FIG. 8 shows another example embodiment of a vessel. In particular, the drawing shows stemware vessel 52, which includes a substantially conical, fluid-confining surface 54, a basal surface 32" disposed below the fluid-confining surface, and a load-bearing, reflectively clad light guide 56. In the embodiment illustrated in FIG. 8, the load-bearing, reflectively clad light guide is further configured to support an entire weight of a fluid confined by the fluid-confining surface. The load-bearing, reflectively clad light guide includes a first window 36" partly defining the basal surface and a second window 38" partly defining the fluid-confining surface. In the illustrated embodiment, the second window is disposed in a non-apical region of the fluid-confining surface. This configuration places the second window of the light guide at a desired height in the drink, while making it relatively unobtrusive and thereby preserving the aesthetic appeal of the vessel. In the embodiment illustrated in FIG. 8, the load-bearing, reflectively clad light guide forms a substantially circular arc that subtends an acute central angle. In this and similar embodiments, the acute central angle may be 35° or less: 25°, 10°, for example.

As shown in FIG. 8, fluid-confining surface 54 and basal surface 32" are separated in this embodiment by an isolating structure. The isolating structure comprises an optically reflective layer 58 adapted to adhere to the light guide. This aspect is further illustrated in a cross-sectional view of load-bearing, reflectively clad light guide 56 in the plane A-A, as illustrated in FIG. 9. The optically reflective layer may be included to minimize interferences in image brightness that might otherwise result from a customer grasping or touching the light guide when the stemware vessel is placed on the tabletop. Optically reflective layer 58 may comprise virtually any substance—aluminum, for example—which is suitably reflective when applied as an adherent layer over the light-guide. In other embodiments, a protective layer (not shown in the drawings) may be disposed over optically reflective layer 58 to prevent the optically reflective layer from being rubbed off when the stemware vessel is held by the light guide. The protective layer may be a spray-on polyacrylic, for example.

Returning now to FIG. 8, it will be appreciated that basal surface 32" in this embodiment is adapted to contact tabletop 14 in a first region directly below the first window and in a second region 40 surrounding the first region, but to stay off the tabletop over a third region 42 between the first and second regions. This aspect is further illustrated in the cross-sectional view of the interface B-B, which is shown in FIG. 10.

Figure 11:
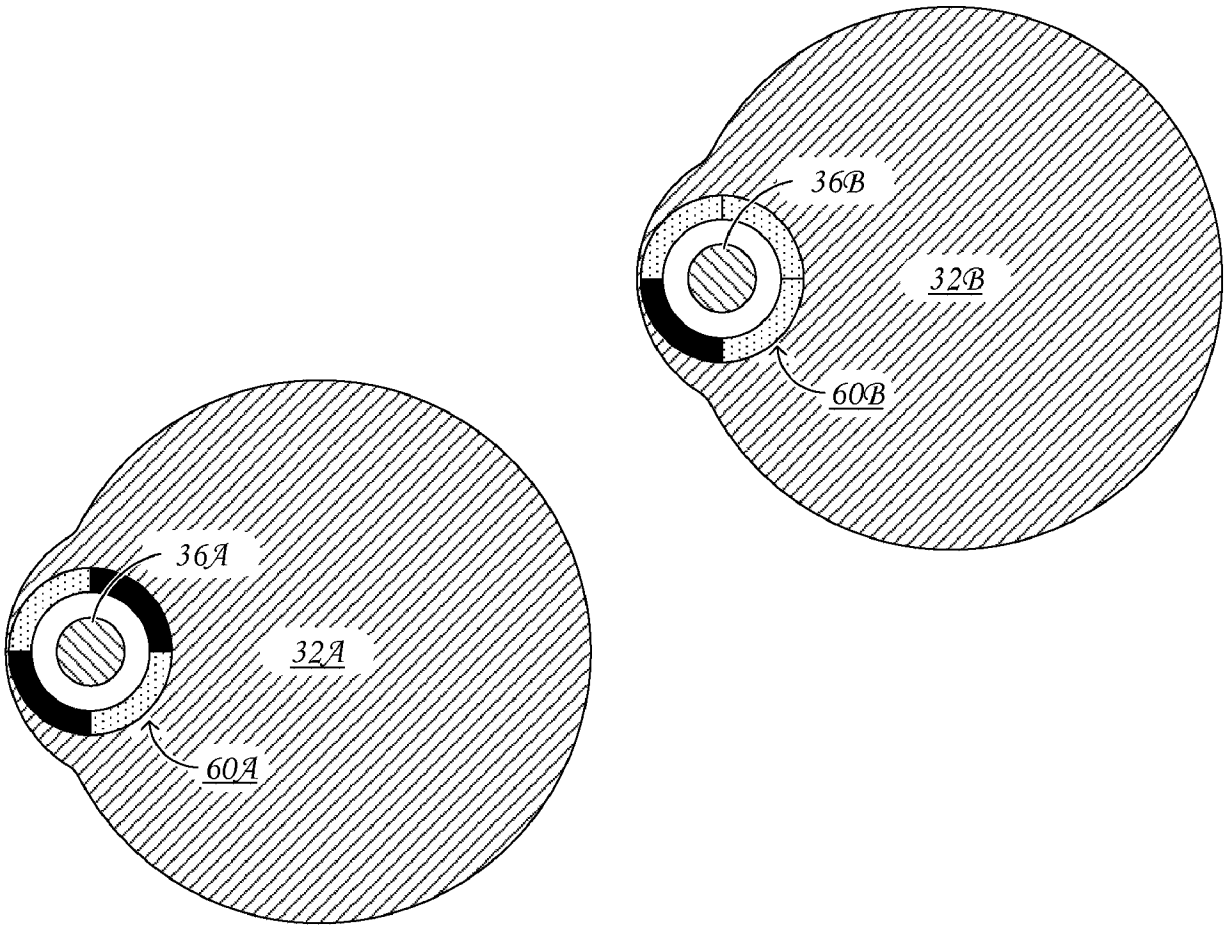
FIG. 11 shows a cross-sectional view of the interface between a tabletop and two other example vessels, in accordance with the present disclosure.

FIG. 11 shows a cross-sectional view of the interface between tabletop 14 and two other example vessels. In this embodiment, each of the basal surfaces of the vessels, 32A and 32B, supports a marking 60A and 60B, that distinguishes it from other vessels disposed on the tabletop. Although the basal surfaces of only two vessels are represented in FIG. 11, it will be understood that virtually any number of vessels may be disposed on the tabletop, and each one may have a marking formed at its basal surface. Each marking may comprise two or more contrasting regions: reflective and less reflective regions, scattering and less scattering regions, polarizing and less polarizing regions, etc. The markings may be formed in the basal surfaces of the vessels by dyeing or painting the basal surfaces, by embedding one or more optically dissimilar materials in the basal surfaces, by selectively etching or polishing the basal surfaces, or in any other suitable manner.

In still other embodiments, markings 60A and 60B may be formed separately from vessels 32A or 32B and subsequently attached to the vessels. The markings may be formed on an adhesive-backed paper or plastic film and stuck to the basal surfaces of the vessels in anticipation of beverage service, for example. After the beverage service, such a marking may be removed and later replaced by another marking.

Markings 60A and 60B may be such as to distinguish one vessel from among M vessels, where M is a large or small integer value that depends on the setting in which the vessels are to be used. For example, when many vessels could be used at the same time and in the same setting, a large M may be desired. Smaller M may be suitable in other settings. Example markings of the kind shown in FIG. 11 can distinguish each vessel from among 15 otherwise similar vessels. It will be understood that markings of various other configurations are equally embraced by this disclosure—markings comprising bar codes or series of contrasting shapes—dots or hexagons, for example. Further, although the markings shown in FIG. 11 are confined to a generally circular region, markings spanning differently shaped geometric regions are also contemplated.

Accordingly, image-receiving device 20 may be configured to recognize a marking on the basal region of each vessel and thereby distinguish one vessel from another. In this manner, the image-receiving device may be further configured to indicate which of a plurality of vessels disposed on tabletop 14 contains less than a threshold amount of liquid, and consequently, which of a plurality of customers seated at table 10 should be offered a beverage refill. In these and other embodiments, the markings may be further configured to distinguish one beverage from another. Beverage-specific markings may be of the replaceable kind referred to above. In still other embodiments, a vessel may include a first marking integral to the vessel and a second, replaceable marking. Such combinations of markings may enable the image-receiving device to recognize both the vessel configuration and the beverage contained within the vessel.

By surrounding the regions corresponding to first window 36A and 36B, markings 60A and 60B may serve yet another purpose, viz., to enable image-receiving device 20 to more readily identify the parts of a captured image corresponding to the first windows of each vessel disposed on tabletop 14 (first windows 32A and 32B in this example). This feature may be especially valuable when the table is being used in non-ideal ambient lighting or other conditions that may degrade the S/N of the intensity determinations described hereinabove. A similar advantage may be provided in other contemplated embodiments, where the marking may not surround the first window of the light guide, but nevertheless bears a fixed, positional relationship to the first window, from which the location of the first window on the basal surface may be predicted.

Finally, it will be understood that the articles and systems described herein are exemplary in nature, and that these specific embodiments or examples are not to be considered in a limiting sense, because numerous variations are contemplated. Accordingly, the present disclosure includes all novel and non-obvious combinations and sub-combinations of the various systems and methods disclosed herein, as well as any and all equivalents thereof.

The invention claimed is:

1. A vessel comprising:

a fluid-confining surface;

a basal surface disposed below the fluid-confining surface;

a light guide including a first window which is part of the basal surface and is positioned to contact a surface on which the vessel is placed, and a second window which is part of the fluid-confining surface and is disposed above a lowest point of the fluid-confining surface, the second window providing a convex boundary region in the fluid-confining surface and a complementary concave boundary region in the light guide; and an isolating structure including an air-filled jacket substantially surrounding the light guide between the first and second windows and configured to reduce loss of light admitted and projected back through the first window of the light guide.

2. The vessel of claim 1, wherein the fluid-confining surface and the basal surface are spatially distinct sections of the same surface.

3. The vessel of claim 1, wherein the isolating structure comprises an optically refractive layer adapted to adhere to the light guide, the optically refractive layer having a lower refractive index than a material of the light guide to which it adheres.

4. The vessel of claim 3, wherein the light guide comprises a polycarbonate monolith, and the isolating structure has a lower refractive index than polycarbonate.

5. The vessel of claim 1, wherein the second window comprises a partial spherical surface.

6. The vessel of claim 1, wherein the second window comprises a conical surface.

7. The vessel of claim 1, wherein the light guide further comprises a light pipe coupled between the first and second windows, and wherein a horizontal cross section of the light pipe is either elliptical or polygonal.

8. The vessel of claim 1, wherein the basal surface further comprises an anti-reflective coating.

9. The vessel of claim 1, wherein the second window defines a non-axial side region of the fluid-confining surface.

10. The vessel of claim 1, wherein the fluid-confining surface defines a space having $C_s$ point symmetry.

11. The vessel of claim 1, further comprising a marking supported on the basal surface, the marking comprising two or more contrasting regions and distinguishing the vessel from among a plurality of otherwise similar vessels.

12. A system for indicating when to offer a beverage refill to a customer, the system comprising:

a tabletop;

a vessel comprising:

a fluid-confining surface;

a basal surface disposed below the fluid-confining surface; and a light guide including a first window which is part of the basal surface and is positioned to contact a surface on which the vessel is placed, and a second window which is part of the fluid-confining surface, and an isolating structure including an air-filled jacket substantially surrounding the light guide between the first and second windows and is disposed above a lowest point of the fluid-confining surface, the second window providing a convex boundary region in the fluid-confining surface and a complementary concave boundary region in the light guide, the basal surface configured, when the vessel is rested on the tabletop, to contact the tabletop in a first region directly below the first window and in a second region surrounding the first region, but to stay off the tabletop over a third region between the first and second regions;

an illuminant configured to project light onto the basal surface;

a detector responsive to light projected from the basal surface; and an image-receiving device operatively coupled to the detector and configured to indicate when an intensity of the light projected from the basal surface exceeds a threshold intensity.

13. The system of claim 12, further comprising an isolating structure substantially surrounding the light guide between the first and second windows and configured to reduce loss of light admitted and projected back through the first window of the light guide.

14. The system of claim 12, wherein the tabletop and the light guide are at least partly transparent in one or more overlapping infrared wavelength ranges, and the illuminant is configured to project substantially diffuse, infrared light onto the basal surface.

15. The system of claim 12, wherein the light guide is configured to promote total internal reflection of some of the light projected onto the basal surface.

* * * * *